US006877923B2

(12) United States Patent
Grayden

(10) Patent No.: US 6,877,923 B2
(45) Date of Patent: Apr. 12, 2005

(54) APPARATUS AND METHOD FOR APPLYING A FLOWABLE MEDIA

(76) Inventor: Monte Grayden, 6780 Crackelberry Ter., Woodbury, MN (US) 55125

( * ) Notice: Subject to any disclaimer, the term of this patent is extended or adjusted under 35 U.S.C. 154(b) by 0 days.

(21) Appl. No.: 10/374,634

(22) Filed: Feb. 25, 2003

(65) Prior Publication Data

US 2004/0165932 A1 Aug. 26, 2004

(51) Int. Cl.[7] ..... B05B 11/02

(52) U.S. Cl. ..... 401/48; 401/5; 401/193; 401/266

(58) Field of Search ..... 401/5, 48, 193, 401/138, 139, 261–266

(56) References Cited

U.S. PATENT DOCUMENTS

| | | | | |
|---|---|---|---|---|
| 2,809,513 A | | 10/1957 | Ames | 72/130 |
| 2,824,442 A | | 2/1958 | Ames | 72/130 |
| 2,889,699 A | | 6/1959 | Ames | 72/130 |
| 2,984,857 A | | 5/1961 | Ames | 15/596 |
| 3,103,033 A | | 9/1963 | Ames | 15/555 |
| 3,186,056 A | | 6/1965 | Hoveland | 25/104.5 |
| 3,602,405 A | | 8/1971 | Ames | 222/386 |
| 3,888,611 A | | 6/1975 | Ames | 425/87 |
| 4,132,517 A | | 1/1979 | Ames | 425/87 |
| 4,440,410 A | | 4/1984 | Bradshaw | 280/47.26 |
| 4,516,868 A | | 5/1985 | Molnar | 401/5 |
| 4,907,955 A | | 3/1990 | Snipes | 425/87 |
| 4,958,951 A | * | 9/1990 | Mann | 401/1 |
| 5,143,264 A | | 9/1992 | MacMillan | 222/567 |
| 5,626,272 A | | 5/1997 | Klemansky | 224/674 |
| 5,814,351 A | | 9/1998 | Mower | 425/87 |

* cited by examiner

*Primary Examiner*—Gregory L. Huson
*Assistant Examiner*—Peter deVore
(74) *Attorney, Agent, or Firm*—Schwegman, Lundberg, Woessner & Kluth, P.A.

(57) ABSTRACT

A flowable media dispensing device is shown that includes a removable sealing device that seals a dispensing opening of the dispensing device when not in use, and is removed to expose the dispensing opening during application of the flowable media. The use of a sealing device permits the user to leave unused media such as drywall joint compound inside the dispensing device when not in use. The time consuming step of cleaning the dispensing device after every use is therefore eliminated. Further, media such as drywall joint compound that would previously have been wasted during the cleaning process is saved, providing more efficient use of the dispensing device.

16 Claims, 6 Drawing Sheets

APPARATUS AND METHOD FOR APPLYING A FLOWABLE MEDIA

TECHNICAL FIELD

The following disclosure relates to application of a flowable media to a surface such as a wall. Specifically, the following disclosure relates to application of a mastic such as drywall joint compound during building construction.

BACKGROUND

In several fields, such as building construction, application of a flowable media such as an adhesive, mastic, etc. is needed. An example of drywall joint compound as a flowable media is used in the following disclosure to illustrate embodiments of the invention, however, the invention is not so limited. Other flowable media such as adhesives, mastics, etc. are considered within the scope of the invention.

Flowable media, such as drywall joint compound, is used extensively in new building construction and old building remodeling. Several flowable media are designed to harden after application when a solvent or carrier media evaporates from the flowable media. As a result, these flowable media are typically sold in sealed containers such as plastic buckets, etc. to keep the solvent or carrier from evaporating until after the desired application to a construction surface. The sealed container keeps the flowable media from drying prematurely, and allows storage of the flowable media for extended periods of time.

When applying drywall joint compound, a dispensing tool is commonly used. The dispensing tool typically includes a chamber that holds a large amount of drywall joint compound, which reduces the need to frequently load up a trowel, and the dispensing tool is designed to dispense the compound in a more controlled pattern than a conventional trowel with an even thickness as desired.

Because the drywall joint compound hardens within a few hours, the dispensing tool must be cleaned after each use to prevent residual compound from hardening to the inside surfaces, moving parts, etc. of the dispensing tool. The cleaning process can be quite time consuming, depending on the type of dispensing tool. Additionally, at least some portion of the drywall joint compound is wasted in the cleaning process.

What is needed is a device and method that reduces or eliminates the time consuming cleaning process currently necessary with dispensing devices. What is also needed is a device and method that reduces waste of a dispensed flowable media, such as drywall joint compound.

SUMMARY

The above mentioned problems of a time consuming cleaning process and wasted flowable media are addressed by the present invention and will be understood by reading and studying the following specification. Systems, devices and methods are provided for reducing or eliminating the need to clean a dispensing device. The systems, devices, and methods of the present invention further offer reduced waste of flowable media.

A flowable media dispensing device is shown. In one embodiment, the dispensing device includes a media chamber with a dispensing opening in the media chamber. A leveling blade is included that is shaped for spreading a flowable media in a substantially flat strip during a dispensing operation. Also included is a removable sealing device adapted to seal the dispensing opening when the dispensing device is not in use. The sealing device includes a sealing surface, an attachment portion that holds the sealing surface adjacent to the dispensing opening, and a gripping portion allowing a user to grasp the sealing device. Methods of manufacturing a flowable media dispensing device are also shown, in addition to a method of applying a flowable media.

Also shown is a drywall joint compound dispensing device that includes a joint compound chamber and an accessory attachment portion coupled to the joint compound chamber. A dispensing opening is located in the accessory attachment portion, and a removable sealing device is included that is adapted to seal the dispensing opening when the dispensing device is not in use.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION

Figure 1:
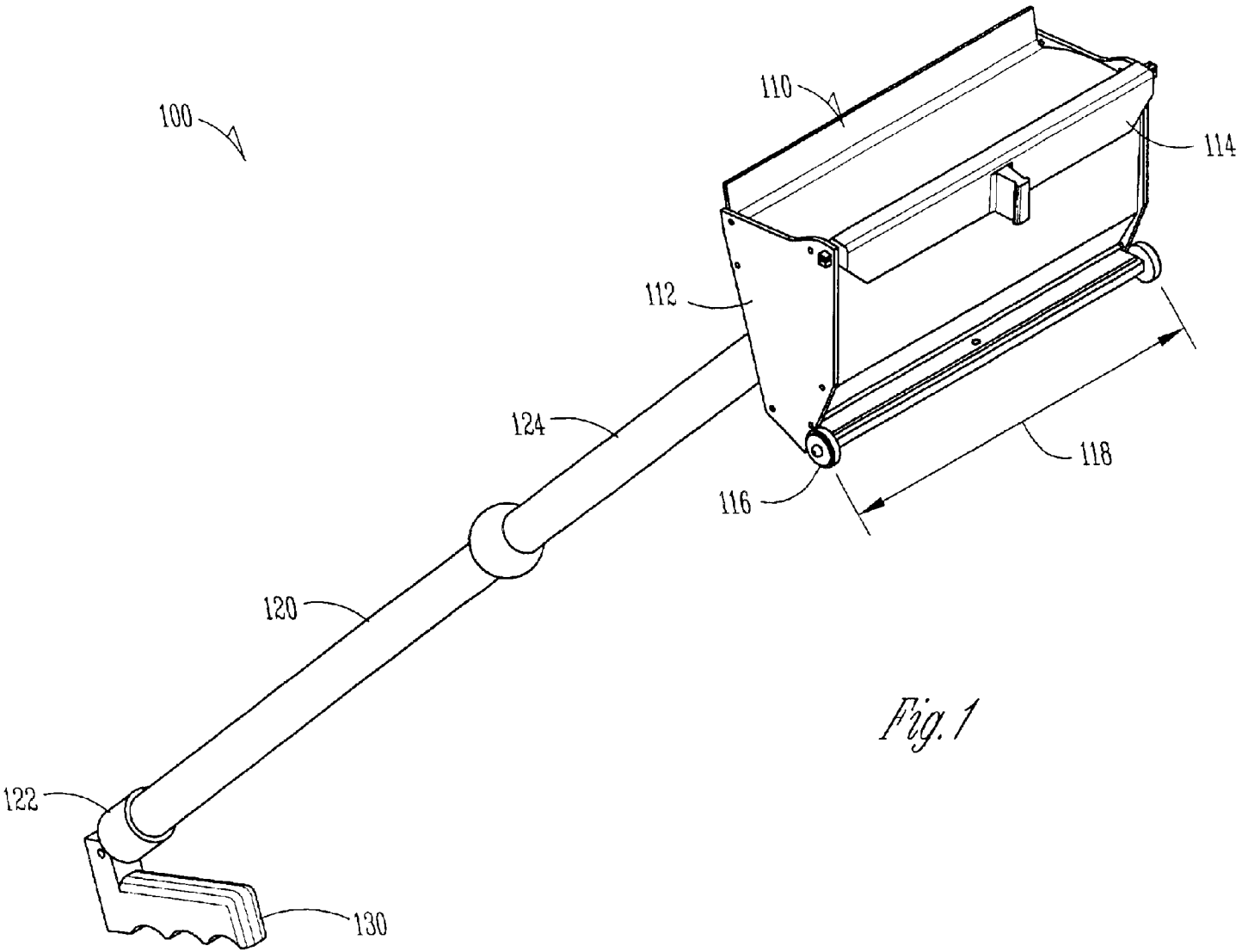
FIG. 1 shows a perspective view of a flowable media application system according to an embodiment of the invention.

In the following detailed description of the invention, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural changes, logical changes, etc. may be made without departing from the scope of the present invention.

FIG. 1 shows a flowable media dispensing system 100. In one embodiment, the dispensing system 100 is adapted to apply drywall joint compound, however, the invention is not so limited. In one embodiment, the dispensing system 100 includes an applicator head 110, and a grip 130 with a handle 120. In one embodiment, the handle 120 is joined to the grip 130 at a first end 122 and to the applicator head 110 at a second end 124. The applicator head 110 is shown with a width 118. Several possible widths are included within the scope of the invention. Examples of desirable widths include, but are not limited to, 4 inches wide, 8 inches wide, 10 inches wide, 12 inches wide, etc.

In one embodiment, the applicator head 110 includes a holding chamber 112 adapted for holding a quantity of drywall joint compound. In one embodiment, the applicator head 110 further includes at least one wheel 116. The embodiment shown in FIG. 1 includes a pair of wheels 116. Wheels 116 are useful to help the applicator head 110 slide against a work surface. In addition, the wheels provide the user with increased control over a distance between the applicator head 110 and the work surface. In one embodiment, a skid plate is used to provide a similar function to the wheels 116.

A sealing device 114 is also shown in FIG. 1. The sealing device is selectively removable from the applicator head 110. When installed on the applicator head 110, the sealing device 114 covers a dispensing opening in the applicator head 110. The dispensing opening is covered by the sealing device 114 in FIG. 1. When a flowable media such as drywall joint compound is being applied, the sealing device 114 is removed to expose the dispensing opening, thus allowing the drywall joint compound to be applied. When not in use, the sealing device is installed in place on the applicator head 110, thus substantially preventing evaporation of any solvent or carrier. The drywall joint compound therefore remains flowable, and does not harden to the inner surfaces or mechanical components of the applicator head 110.

Figure 2A:
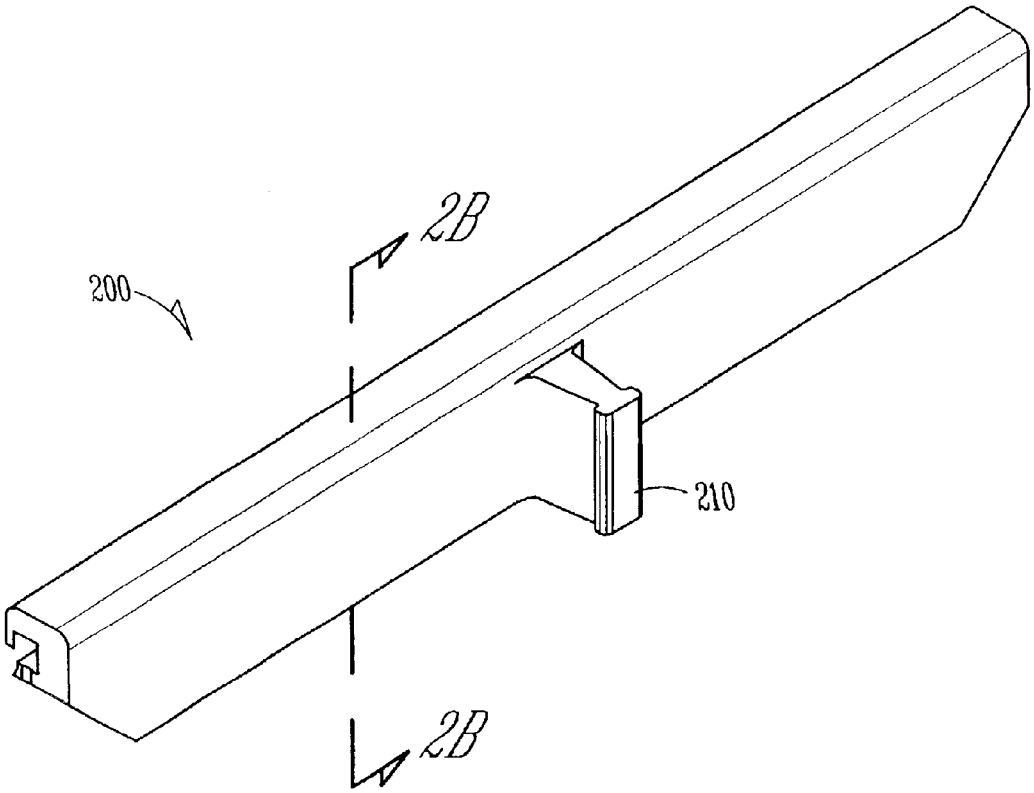
FIG. 2A shows a perspective view of a sealing device according to an embodiment of the invention.

FIG. 2A shows a sealing device 200 according to one embodiment of the invention. The sealing device 200 includes a gripping portion 210 for ease of removal and installation of the sealing device 200. In one embodiment at least a portion of the sealing device includes an elastomeric material such as silicone or other suitable elastomeric material. Elastic properties of an elastomeric material provide advantages such as deformability which is desirable for creating a seal over the dispensing opening and for attachment purposes.

Figure 2B:
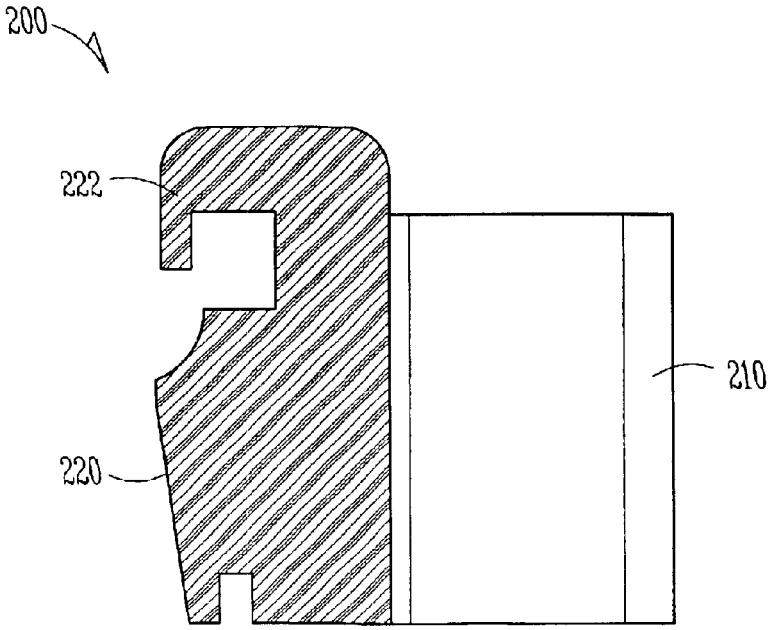
FIG. 2B shows a cross section view of the sealing device of FIG. 2A.

FIG. 2B shows a cross section of the sealing device 200 from FIG. 2A. A sealing surface 220 is shown in the Figure. Also shown is an attachment portion 222. In one embodiment, the attachment portion 222 includes a deformable groove or slot. In one embodiment, an attachment groove is substantially formed from an elastomeric material. Deformable properties and elastic forces of the elastomeric material are used to conform to portions of an applicator head and hold the sealing device in place when the applicator head is not in use. In one embodiment the entire sealing device 200 is formed from an integral piece of elastomeric material. The use of a single integral material utilizes the advantages of elastic properties as discussed above, and concurrently minimizes manufacturing costs by using a single mold to form the sealing device 200.

Figure 3:
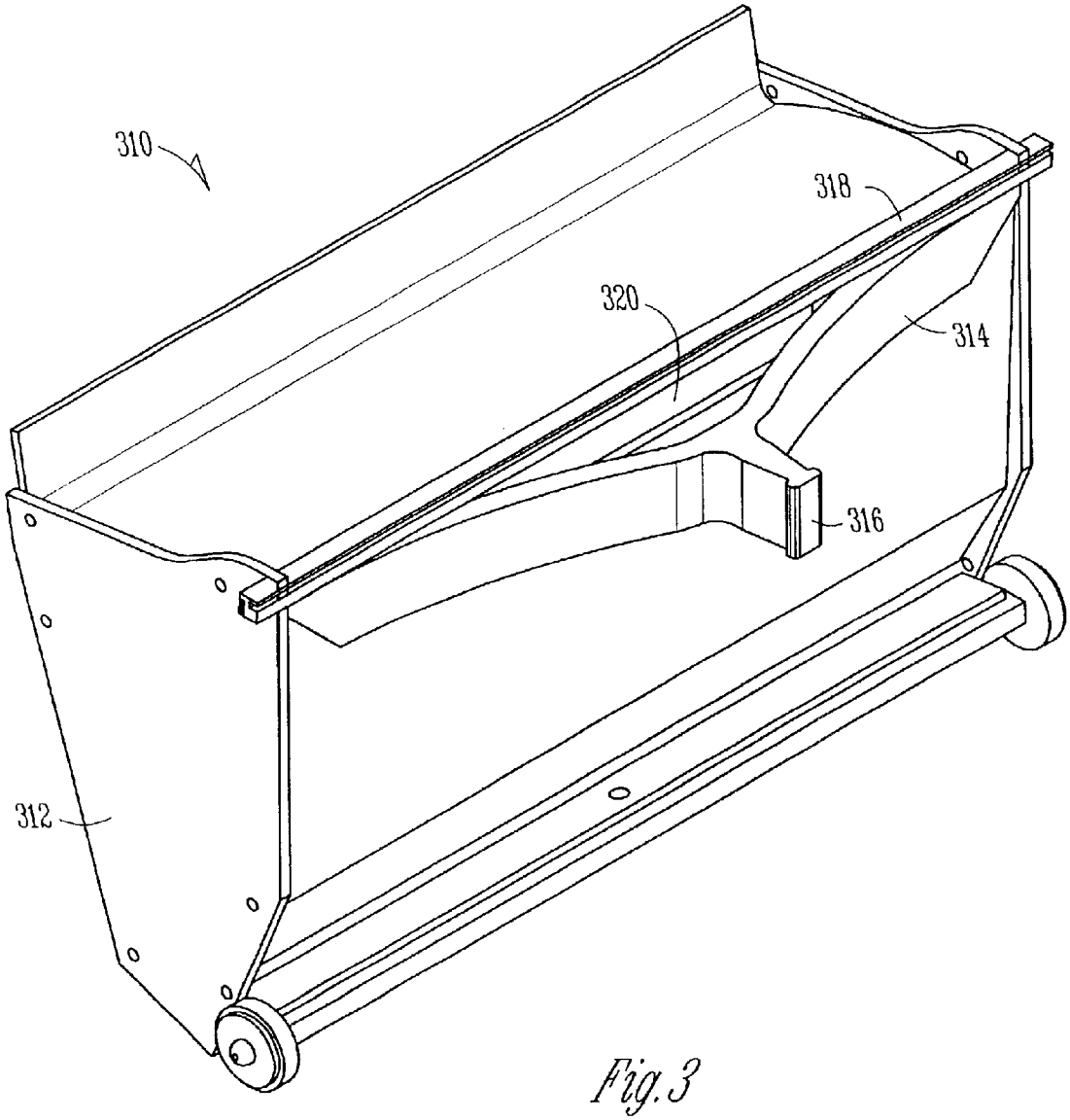
FIG. 3 shows a perspective view of a portion of a flowable media application device according to an embodiment of the invention.

FIG. 3 shows an applicator head 310 according to an embodiment of the invention. The applicator head 310 includes a holding chamber 312 adapted for holding a quantity of drywall joint compound. A leveling blade 318 is shown adjacent to a dispensing opening 320. In FIG. 3, the dispensing opening 320 is shown partially covered by an embodiment of a sealing device 314. The sealing device 314 in FIG. 3 is shown in a partial state of removal from over the dispensing opening 320. In one embodiment, the sealing device 314 includes a gripping portion 316 similar to embodiments described above.

Figure 4A:
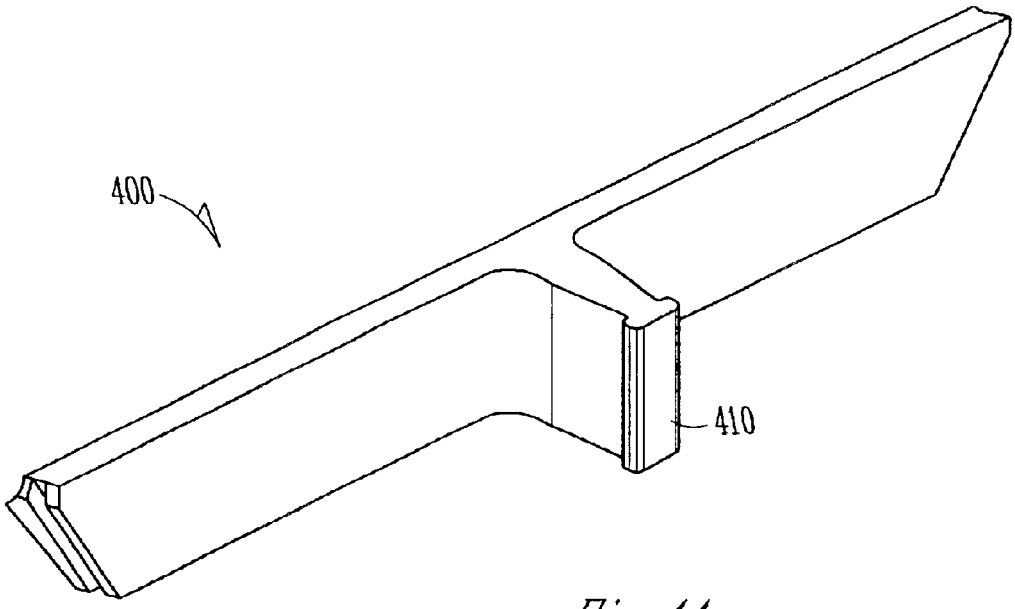
FIG. 4A shows a perspective view of a sealing device according to an embodiment of the invention.
Figure 4B:
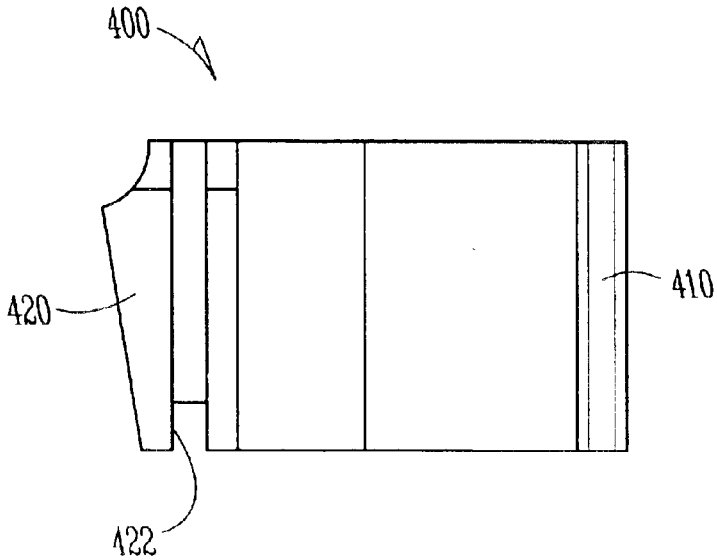
FIG. 4B shows a cross section view of the sealing device of FIG. 4A.

FIG. 4A shows an embodiment of a sealing device 400. FIG. 4B shows a side view of the sealing device 400, including a gripping device 410, a sealing surface 420 and an attachment portion 422. In one embodiment, the attachment portion 422 is adapted to grip a lower edge portion of a dispensing opening such as the dispensing opening 320 from FIG. 3.

Figure 5:
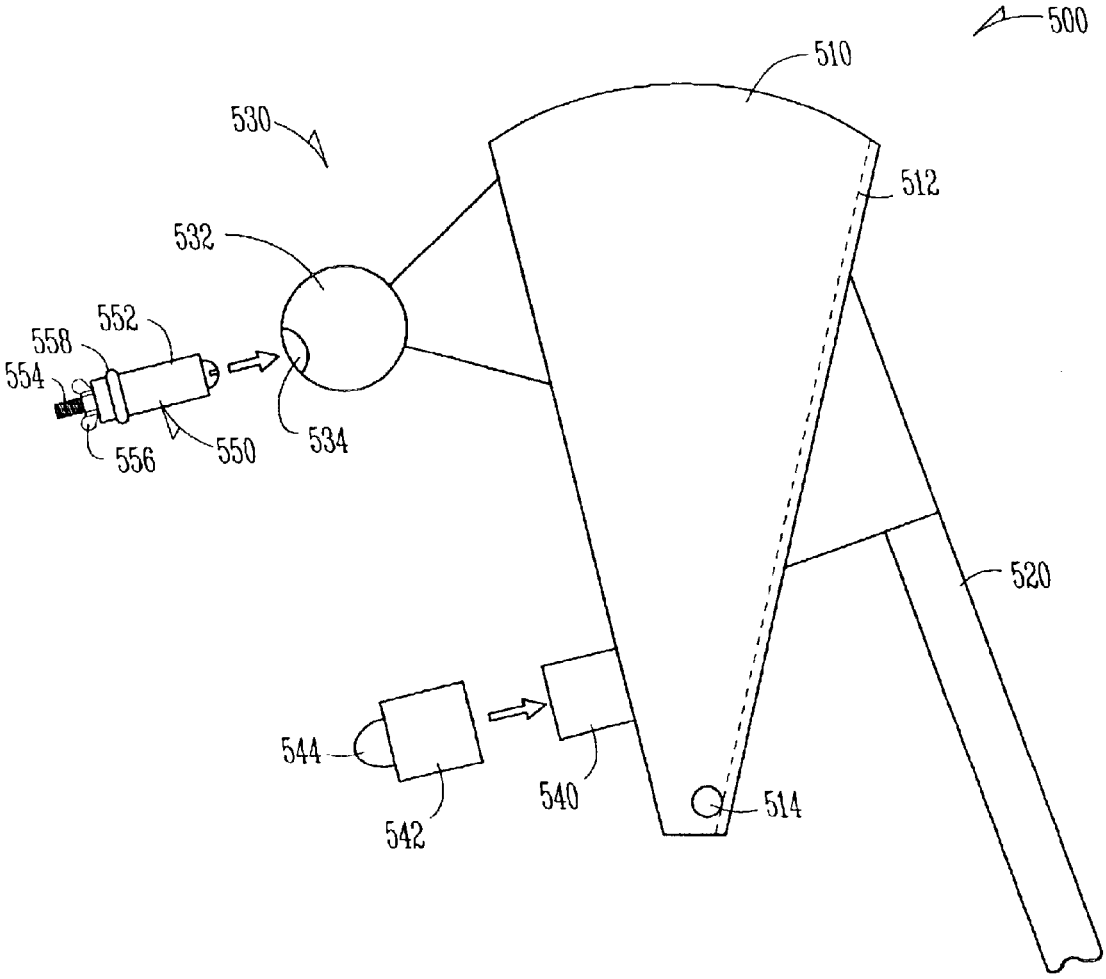
FIG. 5 shows a side view of a flowable media application device according to an embodiment of the invention.

FIG. 5 shows a flowable media dispensing system 500 according to an embodiment of the invention. In one embodiment, the dispensing system 500 includes an angle box. The media dispensing system 500 includes a holding chamber 510 adapted for holding a quantity of flowable media such as drywall joint compound. In one embodiment, the media dispensing system 500 includes a handle 520. A pressure plate 512 is shown in FIG. 5 that is used to force flowable media from within the holding chamber 510 through a dispensing opening 534 in an accessory attachment portion 530. In one embodiment, the pressure plate 512 rotates about a pivot point 514. In one embodiment, the accessory attachment portion 530 includes a ball and socket joint 532. Other attachment portions are within the scope of the invention, such as an attachment surface with a number of mating features such as slots or bolt holes, etc. Although an adjustable accessory attachment portion 530 such as a ball and socket joint 532 is shown in FIG. 5, adjustability is not required in all embodiments of the invention.

A removable sealing device 550 is shown, adapted for selective sealing of the dispensing opening 534. In one embodiment, the removable sealing device 550 is inserted within an inner diameter of the dispensing opening 534 to operate the seal. In one embodiment, the sealing device includes an elastomeric portion 552 that is expanded by tightening a threaded member 554 using an actuating device such as a wingnut 556. In one embodiment, the sealing device 550 includes a shoulder portion 558 to control how far the sealing device 550 is inserted within the dispensing opening 534.

In one embodiment, as shown in FIG. 5, a filling port 540 is further included. The filling port 540 permits a user to more easily refill the holding chamber 510 with drywall joint compound. In one embodiment, a removable sealing device 542 is included to seal the filling port. In one embodiment, the filling port includes a one way spring seated valve within the filling port (not shown). The use of the removable sealing device 542 in addition to the spring seated valve further reduces evaporation of carrier or solvent from the drywall joint compound. In one embodiment, the removable sealing device 542 includes a gripping device 544. In one embodiment, the removable sealing device 542 and the gripping device 544 are integrally formed from a single piece of elastomeric material.

Figure 6:
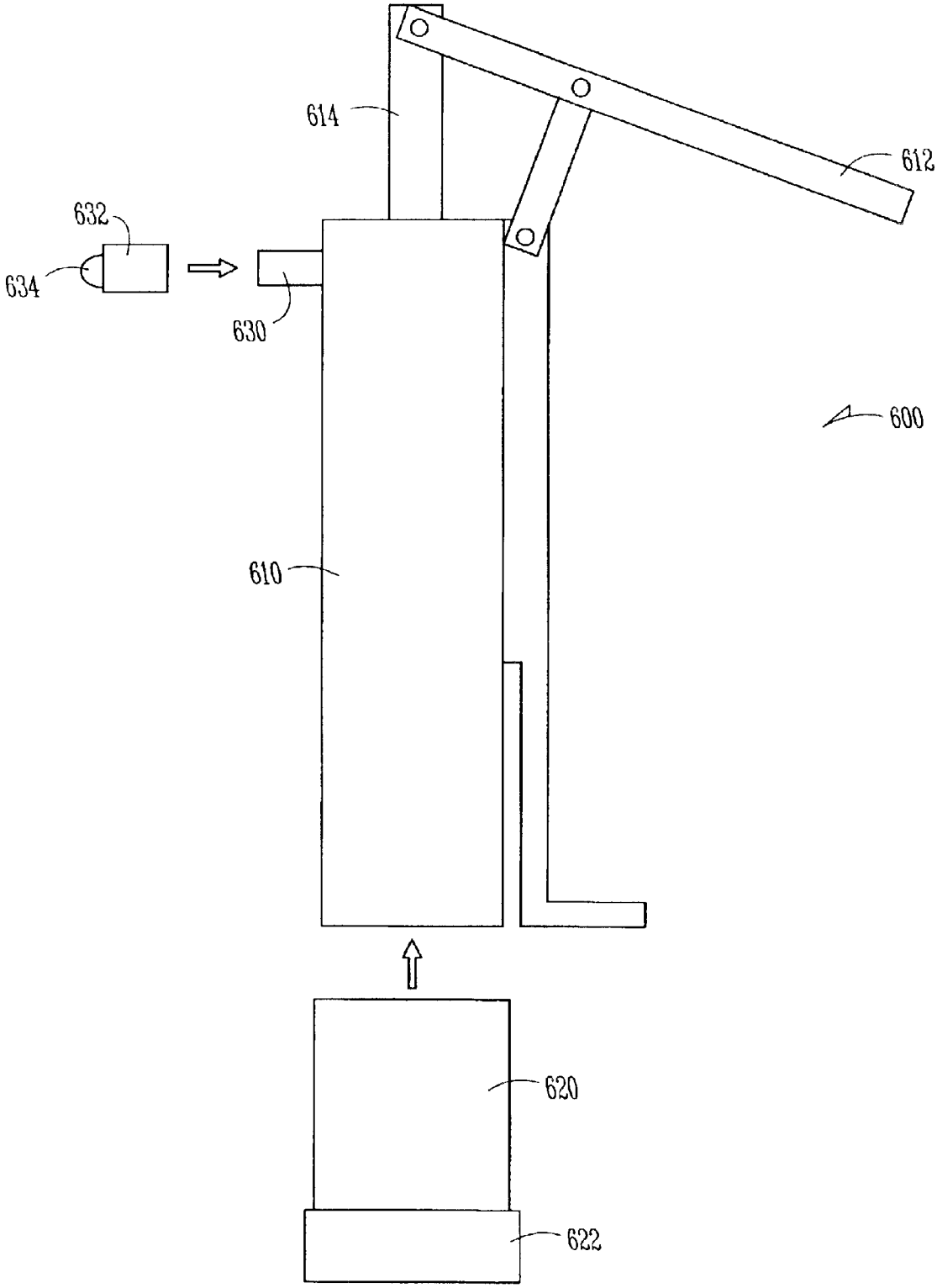
FIG. 6 shows a side view of a portion of a flowable media application system according to an embodiment of the invention.

FIG. 6 shows a flowable media dispensing pump 600. The dispensing pump 600 is adapted for use with a flowable media such as drywall joint compound in one embodiment. In one embodiment, the dispensing pump 600 is used in conjunction with embodiments of a flowable media application device as described above. A fluid line (not shown) such as a hose is used in one embodiment to transport flowable media from the dispensing pump 600 to an embodiment of an application device.

The dispensing pump 600 includes a cylinder 610 with a pressure element 614 such as a piston. A handle 612 is further coupled to the pressure element 614 to allow the user to pump the drywall joint compound. In one embodiment, the dispensing pump 600 is configured to allow the cylinder 610 to fit inside a 5 gallon pail of drywall joint compound. Other sizes and shapes of drywall joint compound, etc. are within the scope of the invention.

A cylinder seal 620 is shown, and is adapted to seal a bottom end of the cylinder 610 when the cylinder is not in operation. In one embodiment, the cylinder seal 620 is a multiple part seal, such as a two part seal. In FIG. 6, a second part 622 of the cylinder seal 620 is shown. In one embodiment, a multiple part seal such as the cylinder seal 620 further permits ease of cleaning. The second part 622 of the cylinder seal 620 is removable for ease of cleaning. In one embodiment, the second part 622 is removably installed onto the cylinder seal 620 using a suitable attachment system such as a screw thread, mating slots, etc.

In one embodiment, the cylinder seal 620 includes a metal tubing portion, with an elastomeric or polymeric insert, such as an O-ring within an upper diameter of the cylinder seal 620. In another embodiment, the cylinder seal 620 and second part 622 are fabricated entirely from an elastomeric or polymeric material.

A dispensing port 630 is shown coupled to the cylinder 610. In operation, flowable media such as drywall joint compound is pumped in from the bottom end of the cylinder 610, and out through the dispensing port 630. A dispensing port seal 632 is shown adapted to seal the dispensing port 630 when the dispensing pump 600 is not in use. In one embodiment, the dispensing port seal 632 includes a gripping portion 634 for ease of installation and removal from the dispensing port 630. In one embodiment, the dispensing port seal 632 is fabricated from an integral elastomeric material.

After a flowable media application procedure, the cylinder seal 620 is placed over the bottom end of the cylinder 610, and the dispensing port seal 632 is placed over the dispensing port 630. The use of seals prevents drying of the flowable media, similar to embodiments described above.

CONCLUSION

Thus has been shown a flowable media dispensing device providing a number of advantages to the user. Embodiments described above are adapted to apply media such as drywall joint compound. Embodiments as described above include a removable sealing device that seals a dispensing opening of the dispensing device when not in use, and is removed to expose the dispensing opening during application of the flowable media. The use of a sealing device permits the user to leave unused media such as drywall joint compound inside the dispensing device when not in use. The time consuming step of cleaning the dispensing device after every use is therefore eliminated. Further, media such as drywall joint compound that would previously have been wasted during the cleaning process is saved, providing more efficient use of the dispensing device.

Although specific embodiments have been illustrated and described herein, it will be appreciated by those of ordinary skill in the art, with the benefit of having read the present specification, that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. A flowable media dispensing device, comprising:

a media chamber;

a dispensing opening in the media chamber;

a leveling blade shaped for spreading a flowable media in a substantially flat strip during a dispensing operation;

a removable sealing device adapted to seal the dispensing opening when the dispensing device is not in use, the sealing device including:

a sealing surface;

an attachment portion that holds the sealing surface adjacent to the dispensing opening;

a gripping portion allowing a user to grasp the sealing device; and wherein the attachment portion includes a deformable slot.

2. The flowable media dispensing device of claim 1, wherein the flowable media includes drywall joint compound.

3. The flowable media dispensing device of claim 1, wherein the dispensing opening includes a slot.

4. The flowable media dispensing device of claim 1, further including at least one wheel attached to the dispensing device.

5. The flowable media dispensing device of claim 1, further including a handle attached to the dispensing device.

6. The flowable media dispensing device of claim 1, wherein the sealing device includes an elastomeric material.

7. The flowable media dispensing device of claim 1, wherein the sealing device is integrally formed.

8. The flowable media dispensing device of claim 7, wherein the sealing device is integrally formed from a single piece of elastomeric material.

9. A method of manufacturing a flowable media dispensing device, comprising:

forming a media chamber;

forming a dispensing opening in the media chamber;

attaching a leveling blade adjacent to the dispensing opening;

forming a removable sealing device adapted to seal the dispensing opening when the dispensing device is not in use, the sealing device including:

providing a sealing surface;

coupling an attachment portion to the sealing surface, the attachment portion adapted to hold the sealing surface adjacent to the dispensing opening;

coupling a gripping portion to the sealing device; and wherein coupling the attachment portion to the sealing surface includes coupling a deformable slot to the sealing surface.

10. The method of claim 9, wherein forming the removable sealing device includes forming an elastomeric removable sealing device.

11. The method of claim 9, wherein forming the removable sealing device includes integrally forming a removable sealing device.

12. The method of claim 11, wherein integrally forming the removable sealing device includes integrally forming a removable sealing device from a single piece of elastomeric material.

13. A method of applying a flowable media, comprising:

filling a media chamber with a flowable media;

dispensing the flowable media through an opening in the media chamber;

spreading the flowable media in a substantially flat strip using a leveling blade;

installing a removable sealing device after a first dispensing use, including:

placing a sealing surface adjacent to the opening in the media chamber;

actuating an attachment portion that holds the sealing surface adjacent to the dispensing opening; and removing the sealing device prior to a second dispensing use, including:

holding a gripping portion coupled to the sealing device;

disengaging the attachment portion from the dispensing opening; and wherein actuating an attachment portion includes actuating a deformable slot that holds the sealing surface adjacent to the dispensing opening.

14. The method of claim 13, wherein installing a removable sealing device includes installing a removable sealing device that includes an elastomeric material.

15. The method of claim 13, wherein installing a removable sealing device includes installing an integrally formed removable sealing device.

16. The method of claim 15, wherein installing an integrally formed removable sealing device includes installing an integrally formed removable sealing device made from a single piece of elastomeric material.

* * * * *